United States Patent [19]

Hijikata et al.

[11] 4,222,799

[45] Sep. 16, 1980

[54] HIGH-STRENGTH SPRING STEEL AND ITS MANUFACTURING PROCESS

[75] Inventors: Toshio Hijikata; Takao Yamazaki, both of Fujisawa; Kiyohiko Fujita, Kasugai, all of Japan

[73] Assignee: Neturen Company, Ltd., Tokyo, Japan

[21] Appl. No.: 960,561

[22] Filed: Nov. 14, 1978

[51] Int. Cl.[2] ..... C21D 1/18

[52] U.S. Cl. ..... 148/143; 148/36; 148/39; 148/150

[58] Field of Search ..... 148/143, 144, 150, 36, 148/39, 154

[56] References Cited

U.S. PATENT DOCUMENTS 3,178,324 4/1965 Grange et al. ..... 148/143

*Primary Examiner*—R. Dean

*Attorney, Agent, or Firm*—Wenderoth, Lind & Ponack

[57] ABSTRACT

The present invention relates to a high-strength spring steel and its manufacturing process. More specifically, it relates to a high-strength spring steel characterized in that it is obtained by heating the surface of the material steel to over the $AC_3$ transformation point by the high-frequency induction heating or the like, stopping the heating and then decreasing the surface temperature of said material steel to below the $Ar_1$ transformation point, this short-time heating of the surface being repeated to secure heating throughout the entire steel body or a condition close to it, under which the steel is quenched, whereby the crystal grains in the steel become increasingly finer from the core to the surface layer of the steel, the crystal grain size of the metal in the surface layer being extraordinarily fine; the invention also relates to the process of manufacturing the steel.

4 Claims, 1 Drawing Figure

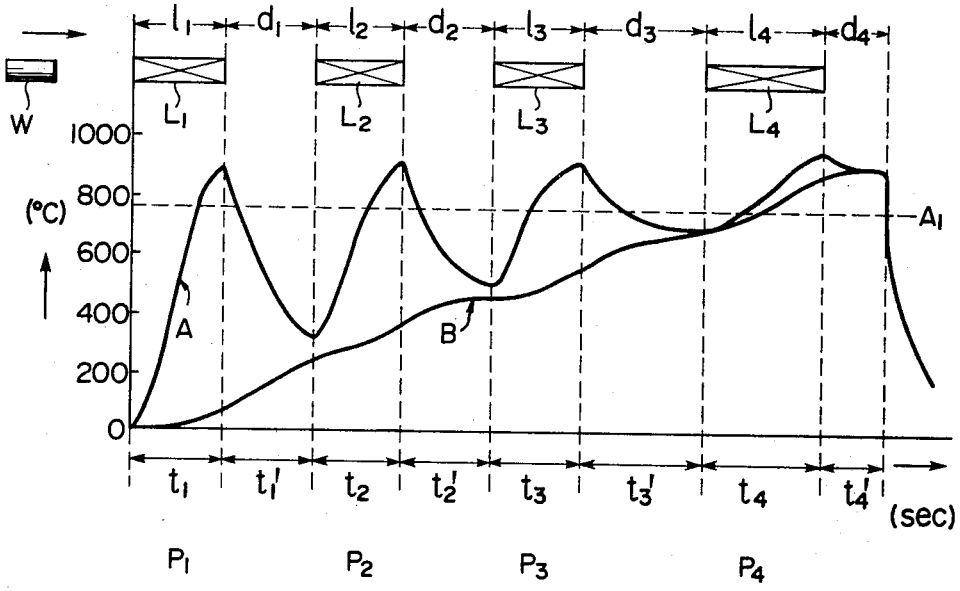
l1
d1
l2
d2
l3
d3
l4
d4
W
L1
L2
L3
L4
1000
800
600
400
200
0
(°C)
A1
A
B
t1
t1'
t2
t2'
t3
t3'
t4
t4'
(sec)
P1
P2
P3
P4

HIGH-STRENGTH SPRING STEEL AND ITS MANUFACTURING PROCESS

BACKGROUND OF THE INVENTION

The present invention relates to a high-strength spring steel with its crystal grains becoming finer from the core to the surface layer and the crystal grains in the surface layer being extraordinarily fine, which is obtained by repeatedly heating for short time intervals the surface of a steel material so as to heat the steel material throughout the entire steel body or bring about a heating condition close to it, by a high-frequency induction heating method or the like, followed by quenching and then tempering by high-frequency induction heating or the like.

To be more specific, the high-strength spring steel according to the present invention is obtained by heating the surface of the steel material to over the $AC_3$ transformation point and then decreasing the surface temperature of said steel to below the $Ar_1$ transformation point after stopping the heating, this cycle of rapid heating and cooling of the steel being successively repeated until a thorough heating of the entire volume of the steel piece or a condition close to is is brought about, which is followed by quenching of the steel.

DESCRIPTION OF THE PRIOR ART

It is a most required characteristic that materials for coil springs, torsion bars and the like should have high fatigue strength, especially high torsion fatigue strength.

Meanwhile, the bending or twisting stresses working on this kind of spring in its service, increases toward the surface thereof around its neutral axis and the maximum stress usually develops in the surface layer of the spring.

In the conventional practice of manufacturing say, a coil spring, a spring steel which has been drawn and then oil-tempered to increase its strength is coldformed into a spring; or a spring steel which has been coiled is quenched and tempered to increase its strength. In either method, it is intended to obtain a uniform quenched and tempered structure of the steel over the whole section through a routine heat treatment. Thus, the conventional method of manufacturing a spring steel cannot produce a spring with a strength distribution matching the stress distribution which develops in the spring under service condition. Moreover, in the conventional method of manufacturing the coil spring or in the conventional quenching-tempering process of the spring steel wire, in which the whole section of the steel wire is heated to the core only once to over the $AC_3$ transformation point and then immediately quenched, no particular consideration is paid to making the crystal grains finer.

One means of making the crystal grains of steel finer is known as the "Repeated Quenching Process " and it is disclosed in U.S. Pat. No. 3,178,324, however, such method is not used in making steel springs. According to this process, the material steel is heated over its entire section to over the $AC_3$ transformation point and then forcibly cooled to render its structure martensitic, this cycle being repeated more than two times in succession.

If the above known process were applied to quench a coil spring or a spring steel, fine crystal grains may be produced, but since the effect of making the grains fine takes place uniformly over the entire section of the steel, this process is also hardly able to produce a spring with a strength distribution matching the stress distribution which develops in the spring under its service conditions.

SUMMARY OF THE INVENTION

With the above discussion in mind, the object of the present invention is to provide a spring steel characterized by being highly strong, highly tough with high resistance to fatigue and having extraordinarily fine grains in its topmost surface layer as well as a strength distribution matching the distribution of bending or twisting stresses which develop in the spring under its service conditions.

The high-strength spring steel according to this invention is obtained by heating the surface of the material steel to over the $AC_3$ transformation point by the high-frequency induction heating method and then decreasing the surface temperature to below the $Ar_1$ transformation point through the heat conductivity of the steel itself after stopping the heating, this cycle of rapid heating and cooling being successively repeated to heat the steel piece throughout or bring about a condition close to it, followed by quenching of the steel.

BRIEF DESCRIPTION OF THE DRAWINGS

Other objects, features and advantages of the present invention will become apparent from the following detailed description in conjunction with the attached drawing, which is a schematic diagram explaining the thermal cycle used in the process of the present invention.

DESCRIPTION OF THE PREFERRED EMBODIMENTS

Referring to the attached drawing, the present invention will be described in detail.

As described above, the conventional coil spring manufacturing method aims at attaining a uniform quenched-and-tempered structure of the steel over its entire section through the routine heat treatment and accordingly, this conventional method could hardly be expected to produce a spring having a strength distribution matching the stress distribution which develops in the spring under service conditions; and since, in said heat treatment, the steel over its entire section to the core is heated only once up to the $AC_3$ transformation point and immediately thereafter quenched, the crystal grains cannot be made fine.

Meanwhile, as also pointed out above, there is a well-known method of repeated quenching, though not applied for the manufacture of a spring, as a means of rendering the crystal grains fine. According to this method, the steel over its entire section is rapidly heated to over the $AC_3$ transformation point and then forcibly cooled to the ambient temperature, this thermal cycle of rapid heating and cooling being repeated to render the crystal grains in the steel finer, thereby rendering the strength, particularly the fatigue strength of the steel.

The features distinguishing the present invention from the above prior art are as follows:

(1) Whereas in the above prior art, i.e. in the art of manufacturing a spring as well as in the art of rendering the crystal grains in the steel finer, rapid heating is done to heat the steel over its entire section to over the $AC_3$ transformation point, according to the present invention only the surface layer of the steel is heated to over the $AC_3$ transformation point.

(2) Whereas in the prior art of rendering the crystal grains in the steel finer over its entire section is repeatedly quenched to make the crystal grains finer, according to the present invention only a surface heating of the steel is effected and from the cooling done between the repeated heatings, the steel is cooled to below the $AR_1$ transformation point by virtue of its own heat conductivity.

(3) Whereas in the prior art of either manufacturing a spring or rendering the crystal grains in the steel finer, the steel, which has been heated over its entire section to over the $AC_3$ transformation point, is forcibly cooled down to the ambient temperature, according to the present invention only the surface layer of the steel is heated to over the $AC_3$ transformation point, except in the final stage of repeated heating. Therefore, after the heating is stopped, the steel can be cooled in a short time to below the $AR_1$ transformation point by its self-cooling action due to its own heat conductivity without resorting to a forcible cooling. Thus, in the prior art, after cessation of rapid heating, the steel over its entire section is forcibly cooled to the ambient temperature, but in the present invention after cessation of rapid heating, the steel in the surface layer is cooled in a short time to below the $Ar_1$ transformation point (not at ambient temperature) without resorting to a forcible cooling, this thermal cycle being repeated, whereby the core of the steel is gradually heated to attain a steel thoroughly heated throughout the entire volume of the steel or a condition close to it, followed by rapid cooling to quench the steel.

Accordingly, the above prior art method of rendering the crystal grains in the steel finer uniformly over the entire section of the steel is quite dissimilar to the present invention wherein the crystal grains are made increasingly fine from the core to the surface layer and in which the grains in the surface layer are rendered extraordinarily fine. The present invention therefore provides an epochmaking art of manufacturing a spring steel in that it can impart to the steel a strength distribution matching the service conditions of the spring.

It is self-evident to anyone skilled in the art that the $AC_3$ transformation point and the $Ar_1$ transformation point, mentioned above, depend on the steel grade and its chemical composition.

The essential feature of the present invention lies in that the material steel over its entire section is heated by a short-time high-frequency induction surface heating repeated with a specified pause, whereby the effect of through heating or an effort close to it is brought about and this is followed by tempering the steel by high-frequency induction heating or the like.

Next, an embodiment of the present invention is to be described referring to the drawing, which illustrates the relation of temperatures in the core and on the surface of a steel high-frequency induction heated according to the present invention, the ordinate being the temperature and the abscissa the time.

$L_1$–$L_4$ representing the high-frequency induction heating coils disposed in series along the traveling path of the steel wire. The wire W traveling in the arrow direction is submitted to the thermal cycle of the present invention in the process of the wire passing through said high-frequency induction heating coils $L_1$–$L_4$. It goes without saying that the size of the wire and the frequency of induced electric power should be appropriately related to each other. Moreover, the thermal cycle in said induction heating coils $L_1$–$L_4$ can be so designed that the surface layer of the wire may have the temperature rise characteristic A and the core of the wire may have the temperature rise characteristic B, as illustrated in the drawing, by appropriately setting the variables such as the numbers of induction heating coils $L_1$–$L_4$ disposed along the wire traveling path, the lengths $l_1$–$l_4$ of respective coils, the intervals $d_1$–$d_4$ of said coils and the densities of power $P_1$–$P_4$ supplied to respective coils, as related to the wire traveling speed.

Thus, the surface temperature of the wire W rises to over the $AC_3$ transformation point in the heating of $t_1$ seconds in the first thermal cycle by the coil $L_1$, but during $t_1$, seconds of air-cooling from the time the wire goes out of the coil $L_1$ to the time it goes into the coil $L_2$, the surface temperature of the wire drops to below the $Ar_1$ transformation point. In the heating of $t_2$ seconds in the second thermal cycle by the coil $L_2$, the surface layer of the wire again attains a temperature exceeding the $AC_3$ transformation point and in the air-cooling of $t_2$ seconds, after the wire W leaves the coil $L_2$, the surface layer attains a temperature below the $A_1$ transformation point. Thereafter, a similar thermal cycle is repeated.

Meanwhile, the core of the wire W is still close to ambient temperature, while it is in the first thermal cycle by the coil $L_1$, but as the thermal cycle is repeated, the temperature steadily rises and, for instance, when the cycle by the coil $L_4$ is finished, a temperature above the $AC_3$ transformation point is attained. In this stage, the surface temperature does not drop to below the $Ar_1$ transformation point by $t_4'$ seconds of air-cooling and in consequence, the same effect as in through heating is brought about; and the wire is quenched by rapid cooling in this stage.

After the quenching is finished, and the work heated, if it is a wire, it is successively tempered; and if it is a rod of definite length, it is successively tempered or tempered on a separate line by known methods, such as high-frequency induction heating, to impart to the steel the required mechanical properties.

To verify the effect of this invention, the present inventor has performed various tests, some of which are cited here.

Example of Test 1

(1) Test Conditions (1) Test piece:

Diameter 10 mm

Chemical composition conforming to the values specified in Japanese Industrial Standard JIS G 4801 as SUP 6:

| | | | |
|---|---|---|---|
| C | 0.55–0.65% | P | less than 0.035% |
| Si | 1.50–1.80% | S | less than 0.035% |
| Mn | 0.70–1.00% | | |

(2) Disposition of Induction Heating Coils:

As illustrated, the coils $L_1$–$L_4$ were disposed at specified intervals along the wire traveling path.

(a) Lengths of Coils:

$L_1$–$L_3$=30 mm $L_4$=180 mm (b) Coil Intervals:

$d_1d_2$:120 mm $d_3$:360 mm (3) Heating Conditions:

(a) Power supplied to respective coils:

| $L_1$ | $L_2$ | $L_3$ | $L_4$ |
|---|---|---|---|
| 20 | 15 | 15 | 13 (kW) |

(b) Wire travel speed
120 mm/sec.

(2) Test Procedure

Under the above test conditions, the test piece was submitted to a repeated thermal cycle according to the present invention and, upon conclusion of the fourth thermal cycle, it was quenched with a cooling water.

The duration of induction heating in each thermal cycle was 0.25 sec for $t_1$–$t_3$ and 1.5 sec for $t_4$ and in this heating, the test piece attained a surface temperature of 880° C.–900° C. The quenching of the test piece was immediately followed by tempering at 500° C. for 2 seconds by high-frequency induction heating.

(3) Test Results

A comparison of the sectional crystal grain size was made between the test piece thus-treated and one of the same chemical composition and diameter as the former, which had been heated only once for 3 seconds to 880° C.–900° C. by high-frequency induction heating, followed by quenching and the same tempering as the former. The results are summarized in Table 1 below.

TABLE 1

| | One time heated | Four times cyclically heated | |
|---|---|---|---|
| | Crystal grain size (ASTM Number) | Crystal grain size (ASTM No.) | Hardness |
| Surface layer (1 mm deep from the skin) | 10 | 13 | 46 RC |
| Mid layer (3 mm deep from the skin) | 9 | 11 | 45 RC |
| Core | 9 | 9 | 44 RC |

EXAMPLE OF TEST 2

(1) Test Conditions (1) Test piece:
Diameter 10 mm
Chemical composition Same as in Example 1

(2) Test Procedure

The same test piece of Example 1 was subjected, just as in Example 1, to a heating of four thermal cycles, followed by quenching and tempering. The tensile strength and the completely reversed fatigue strength of this test piece was compared with those of a test piece with the same chemical composition and diameter as the former which had been induction-heated for 3 seconds to 880° C.–900° C., followed by quenching and then the same temperaing as the former as well as those of a test piece which had been subjected to routine tempering with oil. The results are summarized in Table 2 below.

TABLE

| | Tensile strength ($Kg/mm^2$) | Completely reversed bending fatigue strength ($Kg/mm^2$) |
|---|---|---|
| Oil-tempered piece Routine induction | 155 | 44 |
| quenched-tempered piece | 161 | 57 |
| Piece treated according to the present invention | 163 | 66 |

According to the results of other tests conducted by the present inventor, similarly excellent results can be obtained even with a wire having a C-content more or less than 0.3%, if the Mn- and B-contents in it are respectively set at over 1% and 0.001% or a quenchable wire as shown in Table 3 is taken and then submitted to the repeated thermal cycle of this invention.

TABLE 3

| C (%) | Si (%) | Mn (%) | P (%) | S (%) |
|---|---|---|---|---|
| 0.18–0.24 | 0.15–0.35 | 1.35–1.65 | 0.04 | 0.05 |
| 0.17–0.23 | 0.15–0.35 | 1.20–1.50 | 0.03 | 0.03 |

It goes without saying that the number of thermal cycles to be executed is not limited to four as in the above examples.

The present invention covers a wide possibility of more than two such cycles being executed to make the overall heating of the wire or to bring about a condition close to it, depending on the chemical composition of the wire to be employed and on the temperature to which the wire surface is to be heated.

Of course, one can simultaneously resort to an external means to help air cooling and attain an appropriate surface temperature, when the thermal cycle is suspended.

As seen from the above test results, it is possible to obtain a wire with its crystal grains increasingly fine from the core to the surface and having extraordinarily fine structure in the surface layer, according to the method of the present invention, in which the wire is subjected to repeated structural transformation in a short time through surface heating by high-frequency induction heating repeated with a short pause. The wire thus-obtained makes for a spring steel characterized by high toughness and with a strength distribution matching the stresses, such as benging or twisting, which develop in the spring under service conditions.

In the application of the present invention, either a plurality of induction heating coils are disposed at specific intervals and the wire is sent through these coils for repetitions of the thermal cycle; or a short piece of steel is fixed and submitted to similar repetition of a thermal cycle in such coils. Any method may be employed, provided it is capable of subjecting the steel to the above-mentioned thermal cycles.

In the thermal cycle according to the present invention, the heated surface of the wire is cooled by virtue of the heat conductivity of the wire itself and accordingly, the thermal energy consumed does not constitute any loss.

As explained at the outset of this specification, a difference in the energy consumption is evident from the case of repeating the thermal cycle with an externally forced cooling. According to the present process, only about one third ($\frac{1}{3}$) of the power used in a conventional process is employed. This is indeed a highly economical and important energy-saving process which simply cannot be ignored in this age of scarce fuel sources.

What is claimed is:

1. A high-strength spring steel having high toughness and resistance to fatigue, which steel is characterized by fine crystal grains which are increasingly finer from the core to the surface of the steel, whereby the topmost layer has an extraordinarily fine grain structure and which spring steel has a strength distribution matching the bending or torsion stresses therein under service conditions, said steel being obtained by repeatedly heating, at short time intervals, the surface of the steel to over the $AC_3$ transformation point by high-frequency induction followed by cooling the steel after each heating step by permitting the steel to cool naturally below its $Ar_1$ transformation point so as to heat the steel throughout or bring about a condition close to it, followed by quenching and then tempering by use of high-frequency induction.

2. The high-strength spring steel of claim 1, wherein the steel has a C-content larger than 0.3%.

3. A process of manufacturing high-strength spring steel having high toughness and resistance to fatigue which steel is characterized by fine grains which are increasingly finer from the core to the surface of the steel whereby the topmost layer has an extraordinarily fine grain structure and which spring steel has a strength distribution matching the bending or torsion stresses therein under service conditions comprising the steps of:

heating the surface of the steel to over the $AC_3$ transformation point by high-frequency induction for a short time;

ceasing the heating and thereby lowering the surface temperature of the steel to below the $Ar_1$ transformation point by a self-cooling action due to its own heat conductivity; this short-time surface heating cycle being repeated more than two times to secure heating of the steel throughout the entire steel body or to bring about a condition close to it;

and then quenching the steel.

4. The process of claim 3, wherein the steel has a C-content larger than 0.3%.

* * * * *